US010145580B2

(12) United States Patent
Prihoda

(10) Patent No.: US 10,145,580 B2
(45) Date of Patent: Dec. 4, 2018

(54) DUCT FOR AIR TRANSPORT

(71) Applicant: PRIHODA s.r.o., Hlinsko (CZ)

(72) Inventor: Zdenek Prihoda, Hlinsko (CZ)

(73) Assignee: PRIHODO s.r.o., Hlinsko (CZ)

( * ) Notice: Subject to any disclaimer, the term of this patent is extended or adjusted under 35 U.S.C. 154(b) by 0 days.

(21) Appl. No.: 15/520,684

(22) PCT Filed: Oct. 19, 2015

(86) PCT No.: PCT/CZ2015/000124
§ 371 (c)(1),
(2) Date: Apr. 20, 2017

(87) PCT Pub. No.: WO2016/062297
PCT Pub. Date: Apr. 28, 2016

(65) Prior Publication Data

US 2017/0314807 A1 Nov. 2, 2017

(30) Foreign Application Priority Data

Oct. 20, 2014 (CZ) ..... 2014-712

(51) Int. Cl.
*F16L 9/14* (2006.01)
*F24F 13/02* (2006.01)

(52) U.S. Cl.
CPC ..... *F24F 13/0218* (2013.01); *F24F 13/0254* (2013.01); *F24F 13/0263* (2013.01)

(58) Field of Classification Search
CPC . F24F 13/0218; F24F 13/0254; F24F 13/0263
(Continued)

(56) References Cited

U.S. PATENT DOCUMENTS 2,089,492 A * 8/1937 Lambert ..... F16L 9/21 138/144
2,468,902 A * 5/1949 Villiger ..... F16L 59/147 138/114

(Continued)

FOREIGN PATENT DOCUMENTS

JP H07208799 A 8/1995
WO 2006070182 A2 7/2006

OTHER PUBLICATIONS

International Searching Authority, Search Report and Written Opinion issued in International Application No. PCT/CZ2015/000124 dated Feb. 12, 2016 (9 pages).

*Primary Examiner* — James Hook
(74) *Attorney, Agent, or Firm* — Wood Herron & Evans LLP

(57) ABSTRACT

A duct for air transport comprises an inner jacket having an inlet end for connecting the duct to an air supply and an outlet end for connecting the duct to a duct for a further transport or distribution of air, and an outer jacket made of an impervious material and surrounding the inner jacket spaced therefrom. An insulating chamber is formed between the inner jacket and the outer jacket. The inner jacket and the outer jacket are adapted to conduct from the interior space of the inner jacket through the insulating chamber into the ambient atmosphere, namely in an amount of 0.02 to 100‰ of the total volume of air fed into the inner jacket. The area for conducting air into the insulating chamber and the area for conducting air away from the insulating chamber are spaced from each other during the operation of the duct.

15 Claims, 3 Drawing Sheets

(58) Field of Classification Search
USPC ..... 138/99, 148, 112, 114
See application file for complete search history.

(56) References Cited

U.S. PATENT DOCUMENTS

| | | | | |
|---|---|---|---|---|
| 3,601,320 | A * | 8/1971 | Plessis | A01G 25/023 138/114 |
| 3,824,909 | A * | 7/1974 | Horneff | E04B 9/02 454/187 |
| 3,916,991 | A * | 11/1975 | Trump | F24D 12/02 122/20 B |
| 4,144,907 | A * | 3/1979 | v. Schwerdtner | F01D 5/08 138/114 |
| 6,216,745 | B1 * | 4/2001 | Augustynowicz | F16L 59/065 138/114 |
| 6,565,430 | B2 * | 5/2003 | Gebke | F16L 11/02 454/296 |
| 6,848,464 | B2 * | 2/2005 | Ransom | F16K 24/04 137/238 |
| 6,926,040 | B1 * | 8/2005 | Prescott | F16L 59/143 138/113 |
| 7,490,632 | B2 * | 2/2009 | Grebe | F02M 35/10137 138/114 |
| 2006/0199501 | A1 | 9/2006 | Cassidy et al. | |
| 2014/0261701 | A1 | 9/2014 | Deutsch | |

* cited by examiner

DUCT FOR AIR TRANSPORT

CROSS-REFERENCE TO RELATED APPLICATIONS

This application is a Section 371 national phase application of PCT/CZ2015/000124, filed on Oct. 19, 2015, which claims priority to Czech Republic Application No. PV 2014-712, filed on Oct. 20, 2014, the disclosures of which are incorporated by reference herein in their entirety.

FIELD OF THE INVENTION

The present invention relates to a duct for air transport, the duct comprising an inner jacket having an inlet end connectible to an air supply and an outlet end connectible to a duct for a further transport or distribution of air, and an outer jacket made of an impervious material and surrounding the inner jacket spaced therefrom, wherein an insulating chamber is formed between the inner jacket and the outer jacket.

BACKGROUND OF THE INVENTION

In air-conditioning industry, textile ducts are used especially for air distribution, i.e. in rooms, for which the air is intended. Contrarily, metallic ducts are used to transport air towards the respective rooms, the metallic ducts being however substantially heavier, more expensive, more space-consuming and more difficult to clean in comparison to the textile ducts. Alternatively, textile ducts can also be used for conveying air provided that the textile material is imperviously coated, e.g. with PVC, in order to prevent air from being lost while being conveyed. Nevertheless, when cooled air is conveyed through rooms/areas, where high temperatures and/or humidity prevail, condensation occurs on the surface of such ducts causing condensate to drip down therefrom.

This problem can be solved by wrapping an insulating material around the entire duct. This is, however, uneconomic both with regard to the manufacturing cost and with regard to the maintenance cost. Moreover, the weight of the duct becomes significantly higher.

In accordance with U.S. Pat. No. 7,442,121, the aforesaid problem is solved by providing a duct that comprises an inner air-pervious layer, an outer impervious layer and multiple braces arranged between the two layers. The supplied air flows along the inner air-pervious layer of the duct but partly passes through that layer into the space between the inner and outer layers, thus forming an insulation that reduces the risk related to the occurrence of condensation on the outer surface of the duct. The drawbacks of the aforesaid technical solution consist in the complexity of the same and in an insufficient flexibility with regard to adjustment of the air permeability of the inner layer of the duct. In addition to that, the air permeability of said layer spontaneously fluctuates during the operation which is due to the fact that the pores of the textile material gradually become clogged by the impurities contained in the supplied air. Another drawback consists in that the supplied air penetrates the insulating layer along the entire length of the duct, thereby having a temperature, which is similar to that prevailing inside the duct, along the entire length of the duct. In view of the fact that, according to the prior art document, air from the insulating chamber is to be fed to the place of distribution, connection of such duct to an air diffuser is complicated from structural point of view.

SUMMARY OF THE INVENTION

The above mentioned drawbacks of the prior art are largely eliminated by a duct for air transport, said duct comprising an inner jacket having an inlet end for connecting the duct to an air supply and an outlet end for connecting the duct to a duct for a further transport or distribution of air, and an outer jacket made of an impervious material and surrounding the inner jacket spaced therefrom, wherein an insulating chamber is formed between the inner jacket and the outer jacket. According to the invention, the inner jacket is adapted for conducting air away from the interior space of the jacket into the insulating chamber and the outer jacket is adapted for conducting air away from the insulating chamber into the ambient atmosphere, namely such that the amount of air conducted away from the inner jacket through the insulating chamber into the ambient atmosphere is 0.02 to 100 ‰, preferably 0.03 to 10 ‰, especially 0.03 to 1,3 ‰, most preferably 0,1 to 0,8 ‰ of the total volume of air fed into the inner jacket, the area for conducting air into the insulating chamber and the area for conducting air away from the insulating chamber being spaced from each other.

Preferably, the area for conducting air into the insulating chamber is arranged at one end of the duct, preferably at the outlet end of the duct, and the area for conducting air away from the insulating chamber is arranged at the other end of the duct.

According to a particularly preferred embodiment, the inner jacket is made of an impervious material and provided with at least one interconnecting opening for conducting a partial amount of air from the inner jacket into the insulating chamber and the outer jacket is provided with at least one blow-off opening for conducting air away from the insulating chamber, the latter opening being arranged in an area adjoining the inlet end of the duct, the total area of all the blow-off openings being less than or equal to the total area of all the interconnecting openings.

In order to provide said amounts of air being led into the ambient atmosphere and to ensure proper inflation of the insulating chamber, the inner jacket is made preferably of an impervious material and provided with at least one interconnecting opening for conducting a partial amount of air from the inner jacket into the insulating chamber, the total surface area of all the interconnecting openings ranging between 0.04 and 2.5 ‰ of the surface area of the internal cross section of the inner jacket, and the outer jacket is provided with at least one blow-off opening for conducting air away from the insulating chamber, the total surface area of all the interconnecting openings being 2 to 8 times, particularly 5 or 6 times, greater than the total surface area of all the blow-off openings.

The interconnecting openings are arranged preferably in an area adjoining the outlet end of the inner jacket, yet spaced therefrom, and the blow-off openings are is arranged in an area adjoining the inlet end of the duct.

It is also advantageous, when the outer jacket is, at least in the area facing the interconnecting openings, provided with a layer of an insulating material.

Preferably, the duct is provided with suspension elements, each suspension element comprising an end portion for anchoring the inner jacket, an intermediate portion for anchoring the outer jacket and a lug for attaching the duct to a carrying structure.

To enclose the insulating chamber in a direction corresponding to the radial direction of the duct, the duct further comprises—at each end—a funnel-shaped jacket for, the funnel-shaped jacket being attached to the inner jacket with its narrower end and to the outer jacket with its wider end.

According to an especially preferred embodiment, the duct has a circular cross section, the diameter of the inner jacket being by 25 to 60 mm, particularly by 35 to 45 mm, less than the diameter of the outer jacket.

BRIEF DESCRIPTION OF THE DRAWINGS

The present invention will be further described in more detail with reference to the accompanying drawings showing exemplifying embodiments schematically.

DESCRIPTION OF THE EXEMPLARY EMBODIMENTS

Figure 1:
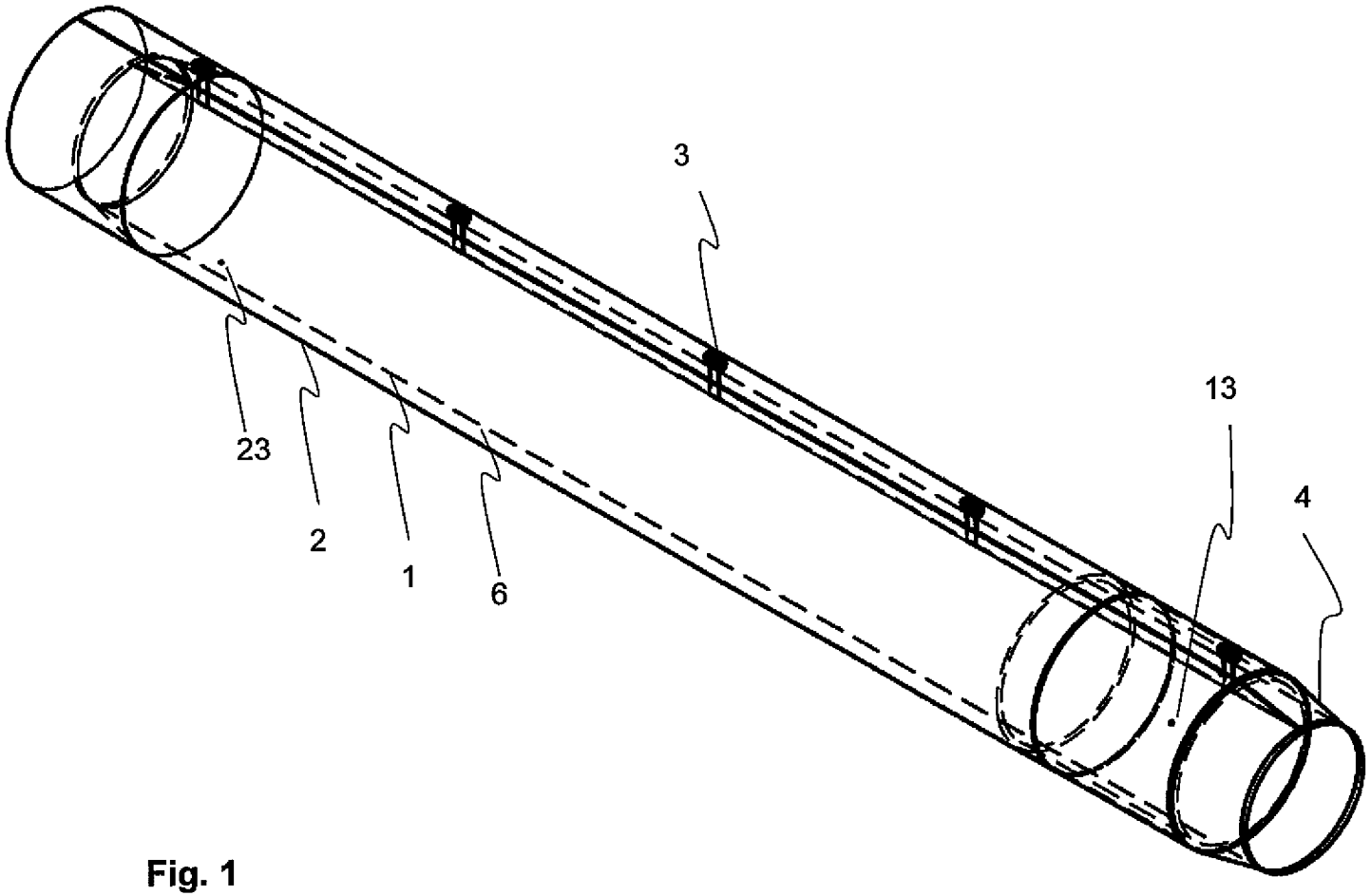
FIG. 1 shows an exemplary embodiment of the duct according to the present invention in a perspective view and FIGS. 2 and 3 show the duct of FIG. 1 in a longitudinal sectional view and in a cross-sectional view, respectively.

The exemplary textile duct shown in the drawings comprises a hose-like inner jacket 1 made of an impervious material, such as a woven fabric consisting of endless polyester fibres and provided with a bonding coat, e.g. of PU, PVC or silicone. The inner jacket 1 is surrounded by a hose-like outer jacket 2 wrapped around the former, the latter being also made of an impervious material, such as a woven fabric consisting of endless polyester fibres and also provided with a bonding coat, e.g. of PU, PVC or silicone. The space between the inner jacket 1 and the outer jacket 2 forms an insulating chamber 6 surrounding the inner jacket 1.

Such duct is washable, which is a major advantage of the invention.

In the particularly preferred embodiment shown in the drawings, the jackets 1, 2 have circular cross section. Nevertheless, they can have any other suitable cross section, such as a semi-circular, triangular or polygonal one. The walls of the outer jacket 2 extend along those of the inner jacket 1, yet spaced therefrom.

The inlet end 11 of the inner jacket 1 is adapted to be connected to an air supply, while the outlet end 12 is connectible to a downstream pipeline for subsequent transport and/or distribution of air.

A funnel-shaped jacket 4, which is arranged at the inlet end 11 of the inner jacket 1, is attached to the outer jacket 2 with its wider end and to the inner jacket of the duct with its narrower end, thus enclosing the insulating chamber 6 between the inner jacket 1 and the outer jacket 2 in an area adjoining the inlet section of the duct. In this exemplary embodiment, the outer jacket 2 extends beyond the funnel-shaped jacket 4 in the longitudinal direction, the extension being formed by an overlapping sleeve 7. A similar funnel-shaped jacket 4 is arranged at the outlet end of the duct, as well.

The duct is provided with suspension elements 3, each suspension element comprising an end portion 31 for anchoring the inner jacket 1, an intermediate portion 32 for anchoring the outer jacket 2 and a lug 33 for attaching the entire suspended assembly to a carrying structure (not shown). The distance between the end portion 31 and the intermediate portion 32 corresponds to the spacing between the inner jacket 1 and the outer jacket 2. When a cylindrical duct is concerned, the aforesaid distance should be substantially equal to the difference between the radii of the outer jacket 2 and the inner jacket 1. Preferably, the suspension element 3, or at least the end portion 31 and the intermediate portion 32 of the suspension element, are also made of a textile material.

Figure 2:
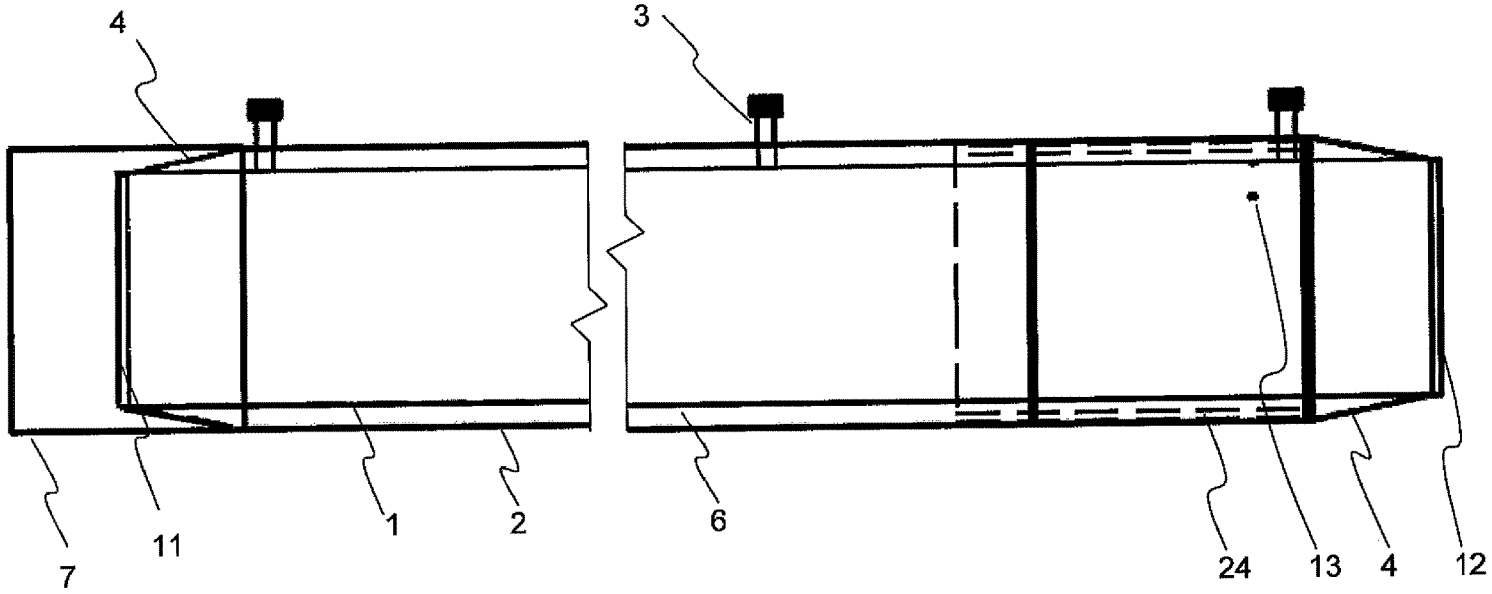
Figure 3:
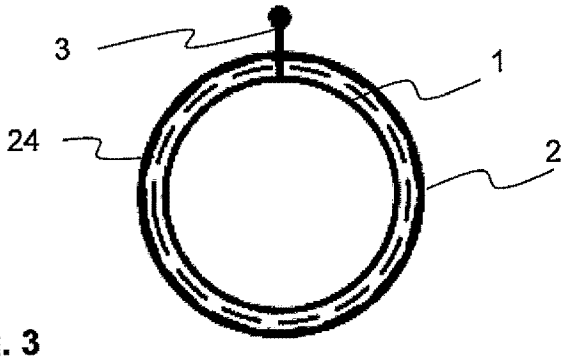
Figure 4:
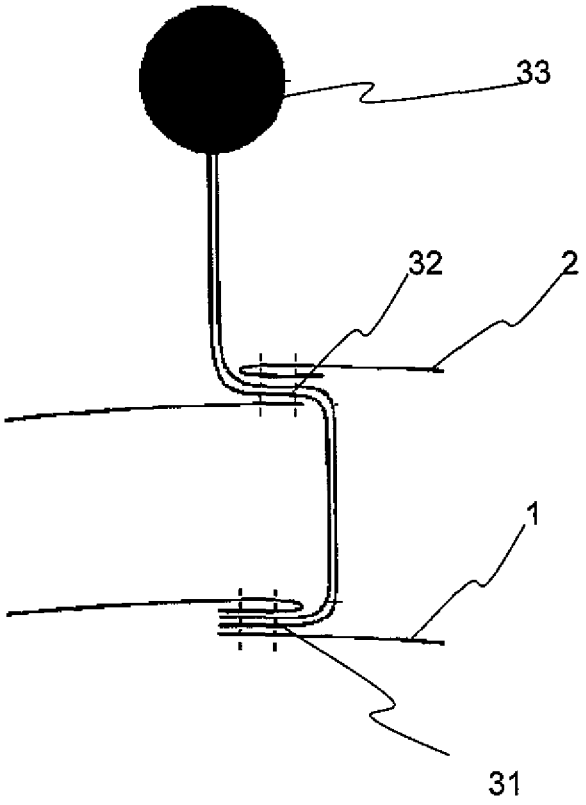
FIG. 4 shows a suspension element for anchoring the duct in a detailed view.

The internal surface of the outlet end 12 of the outer jacket 2 of the duct is provided with a layer 24 of insulating material, such as expanded polystyrene foam (e.g. Yatex from YATE spol. s.r.o.). In FIGS. 2 and 3, the layer 24 of an insulating material is indicated by a dashed line.

The inner jacket 1 is provided with at least one interconnecting opening 13 arranged in the area adjoining the outlet end 12, said interconnecting opening 13 leading from the internal space of the inner jacket 1 to the insulating chamber 6 formed between the inner jacket 1 and the outer jacket 2. Preferably, the number of the interconnecting openings 13 ranges between 1 and 10. The outer jacket 2 is provided with at least one blow-off opening 23 arranged in the area adjoining the inlet end of the duct, said blow-off opening leading from the internal space of the insulating chamber 6 to the ambient atmosphere. Preferably, the number of the blow-off openings 23 ranges between 1 and 5. Preferably, the interconnecting opening(s) 13 is (are) arranged in the upper area of the duct. This means that the interconnecting openings 13 are oriented in the same direction as the suspension elements 3, while the blow-off openings 23 are oriented downwards, i.e. in the opposite direction with respect to the suspension elements 3.

In general, both the interconnecting openings 13 and the blow-off openings 23 are adapted to conduct away an amount of air corresponding to 0.03 to 1.3 ‰ of the total volume of air fed into the inner jacket 1. In the ducts working with the most common pressures and volume flow rates, this can be achieved by providing the inner jacket 1 with the interconnecting openings 13 having a total surface area which corresponds to 0.04 to 2.5 ‰ of the total cross-sectional area of the inner jacket 1. Moreover, with the aim to maintain the inflated shape of the insulating chamber 6, the total surface area of the interconnecting opening(s) 13 is 2 to 8 times, preferably 5 to 6 times greater than the total surface area of the blow-off openings 23. In order to accomplish the above mentioned transfer of air, the size of the interconnecting openings 13, which is suitable for a specific duct having predetermined volume flow rates, can also be found out by way of experiment.

According to a general definition, the inner jacket 1 and the outer jacket 2 should be adapted for conducting air away from the insulating chamber 6 in an amount of 0.02 to 100 ‰, particularly 0.03 to 10 ‰, preferably 0.03 to 1.3 ‰, most preferably 0.1 to 0.8 ‰.

In a particularly preferred embodiment of the present invention, the duct is cylindrical in shape, having a length of 1,000 to 5,000 mm and comprising an inner jacket 1 with a diameter of 200 to 1,500 mm and an outer jacket 2 with a diameter exceeding that of the inner jacket 1 by 25 to 60 mm, preferably by 40 mm, the total surface area of the interconnecting openings 13 ranging between 50 and 90 $mm^2$ (for example three circular interconnecting openings 13, each having 5.5 mm in diameter, arranged on a circle and having mutual angular spacing of 35°) and the total surface area of the blow-off openings 23 ranging between 8 and 16 $mm^2$ (for example, one circular blow-off opening having 4 mm in diameter).

Theoretically, both the interconnecting openings 13 and the blow-off openings 23 can also be replaced with an insertable part made of a pervious material in order to enable a predetermined amount of air to pass from the interior space of the inner jacket 1 into the insulating chamber 6 and from the insulating chamber 6 to the ambient atmosphere. The incorporation of an area comprising a pervious material (a meshwork or a perforated sheet, among others) can be theoretically especially useful with regard to the outer jacket 2 where, in the case of need, the possible clogging of the mesh with dust particles can be checked and easily eliminated. This is particularly the case when such a pervious material is removably attached to the impervious material of the outer jacket. For example, the pervious material can assume a form of a rectangular sheet for covering a larger opening formed in the jacket, such cover being attached to the jacket by means of Velcro.

The element for enabling air to be conducted into the insulating chamber 6, i.e. the interconnecting openings 13 or the corresponding pervious portion, and the element for enabling air to be conducted away from the insulating chamber 6 into the ambient atmosphere, i.e. the blow-off opening 23 or the corresponding pervious portion, are arranged with a mutual spacing which preferably corresponds to at least two thirds of the length of the inner jacket 1, particularly with the greatest possible mutual spacing and with an additional angular shift. Thus, the element for enabling air to be conducted into the insulating chamber 6 can be oriented upwards and the element for enabling air to be conducted away can be oriented downwards.

When in operation, cooled air is blown into the duct according to the present invention, namely into the opening at the inlet end 11 of the inner jacket 1, the respective volume flow rate being e.g. 1000 $m^3/h$ and the respective static pressure being about 50 to 200 Pa, preferably amounting to 100 Pa. The absolutely greatest amount of the air will leave the duct through the opening at the outlet end 12 of the inner jacket 1 and be led out into a downstream diffuser or to another downstream ducting element for air transport. Only a very small amount of air passes through the interconnecting openings 13 into the insulating chamber 6 and subsequently flows through the same towards the area adjoining the inlet end 12 of the inner jacket 1 in order to escape to the ambient atmosphere through the corresponding blow-off opening 23. In view of the fact that the total surface area of the interconnecting openings 13 exceeds that of the blow-off openings 23, a sufficient pressure can build up inside the insulating chamber 6 keeping the same in an inflated state, thereby maintaining the desired spacing between the outer jacket 2 and the inner jacket 1. The static pressure acting is inside the insulating chamber 6 is about half the static pressure acting inside the inner jacket 1 and ranges, e.g., from 30 to 100 Pa. Preferably, this pressure amounts to 50 Pa. Thereby, an insulating air layer is maintained around the inner jacket 2 during the operation of the duct, said insulating layer enabling the condensation on the surface of the duct to be reduced or eliminated. The temperature of air, which prevails in the area of the insulating chamber 6 where air passes from the inner jacket 2 into the insulating chamber 6, e. g. in the area adjoining the outlet end 12 of the duct, is close to the temperature of air inside the inner jacket 1. Therefore, it is useful to provide this area of the outer jacket 2 with a layer 24 of an insulating material, such as a foam one. The temperature prevailing in the portion of the insulating chamber 6, which extends farther from the outlet end 12 of the duct, is higher because the air flowing through the insulating chamber 6 gradually becomes warmer due to the influence of the ambient temperature. Therefore, there is no need to provide the portion extending farther from the outlet end 12 of the duct with any layer 24 of an insulating material, at all.

The above exemplary embodiments are usable without implying any need of inserting or attaching a reinforcing structure. Nevertheless, it may be useful to provide non-circular ducts with reinforcing structures.

The outer jacket 2 is preferably made of a textile material. The inner jacket 1 is also preferably made of a textile material but the scope of the present invention can similarly include an additional alteration of a duct made of a metallic material with the aim to prevent condensation from occurring on the surface of such duct.

Although multiple exemplary embodiments are described above, it is obvious that those skilled in the art would easily appreciate further possible alternatives to those embodiments. Hence, the scope of the present invention is not limited to the above exemplary embodiments and is rather defined by the appended claims.

The invention claimed is:

1. A duct for air transport, said duct comprising:

an inner jacket having an inlet end for connecting the duct to an air supply and an outlet end for connecting the duct to a duct for a further transport or distribution of air, and an outer jacket made of an impervious material and surrounding the inner jacket spaced therefrom, wherein an insulating chamber is formed between the inner jacket and the outer jacket, wherein the inner jacket comprises an area for conducting air away from the interior space of the jacket into the insulating chamber and the outer jacket comprises an area for conducting air away from the insulating chamber into the ambient atmosphere, adapted such that an amount of air conducted away from the inner jacket through the insulating chamber into the ambient atmosphere is 0.02 to 100‰ of a total volume of air fed into the inner jacket, the area for conducting air into the insulating chamber and the area for conducting air away from the insulating chamber being spaced from each other during operation of the duct.

2. The duct according to claim 1, wherein the area for conducting air into the insulating chamber is arranged at one end of the duct, and the area for conducting air away from the insulating chamber is arranged at the other end of the duct.

3. The duct according to claim 2, wherein the area for conducting air into the insulating chamber is arranged at the outlet end of the duct, and the area for conducting air away from the insulating chamber is arranged at the inlet end of the duct.

4. The duct according to claim 1, wherein the inner jacket is made of an impervious material and provided with at least one interconnecting opening for conducting a partial amount of air from the inner jacket into the insulating chamber and the outer jacket is provided with at least one blow-off opening for conducting air away from the insulating chamber, the latter opening being arranged in an area adjoining the inlet end of the duct, the total surface area of all the blow-off openings being less than or equal to the total surface area of all the interconnecting openings.

5. The duct according to claim 1, wherein the inner jacket is made of an impervious material and provided with at least one interconnecting opening for conducting a partial amount of air from the inner jacket into the insulating chamber, the total surface area of all the interconnecting openings ranging between 0.04 and 2.5‰ of the surface area of the internal cross section of the inner jacket, and the outer jacket is provided with at least one blow-off opening for conducting air away from the insulating chamber, the total surface area of all the interconnecting openings being 2 to 8 times greater than the total surface area of all the blow-off openings.

6. The duct according to claim 5, wherein the total surface area of all the interconnecting openings is 5 or 6 times greater than the total surface area of all the blow-off openings.

7. The duct according to claim 4 or 5, wherein the interconnecting openings are arranged in an area adjoining the outlet end of the inner jacket, yet spaced therefrom, and the blow-off openings are arranged in an area adjoining the inlet end of the duct.

8. The duct according to claim 7, wherein the outer jacket is, at least in the area facing the interconnecting openings, provided with a layer of an insulating material.

9. The duct according to claim 1, further comprising:

suspension elements, each suspension element comprising an end portion for anchoring the inner jacket, an intermediate portion for anchoring the outer jacket and a lug for attaching the duct to a carrying structure.

10. The duct according to claim 1, further comprising:

at each end, a funnel-shaped jacket for enclosing the insulating chamber in a direction corresponding to the radial direction of the duct, the funnel-shaped jacket being attached to the inner jacket with a narrower end and to the outer jacket with a wider end.

11. The duct according to claim 1, wherein it has a circular cross section, the diameter of the inner jacket being by 25 to 60 mm smaller than the diameter of the outer jacket.

12. The duct according to claim 11, wherein the diameter of the inner jacket is by 35 to 45 mm smaller than the diameter of the outer jacket.

13. The duct according to claim 1, wherein the amount of air conducted away from the inner jacket through the insulating chamber into the ambient atmosphere is 0.03 to 10‰ of the total volume of air fed into the inner jacket.

14. The duct according to claim 1, wherein the amount of air conducted away from the inner jacket through the insulating chamber into the ambient atmosphere is 0.03 to 1.3‰ of the total volume of air fed into the inner jacket.

15. The duct according to claim 1, wherein the amount of air conducted away from the inner jacket through the insulating chamber into the ambient atmosphere is 0.1 to 0.8‰ of the total volume of air fed into the inner jacket.

* * * * *